US009316965B1

(12) United States Patent
Nakao

(10) Patent No.: US 9,316,965 B1
(45) Date of Patent: Apr. 19, 2016

(54) CLEANING DEVICE, COLLECTING MEMBER, FIXING DEVICE, AND IMAGE FORMING APPARATUS

(71) Applicant: FUJI XEROX CO., LTD., Tokyo (JP)

(72) Inventor: Masayoshi Nakao, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/702,399

(22) Filed: May 1, 2015

(30) Foreign Application Priority Data

Nov. 21, 2014 (JP) ..... 2014-236510

(51) Int. Cl.
*G03G 15/20* (2006.01)
*B08B 1/00* (2006.01)
*B08B 1/04* (2006.01)

(52) U.S. Cl.
CPC ..... *G03G 15/2025* (2013.01); *B08B 1/00* (2013.01); *B08B 1/04* (2013.01)

(58) Field of Classification Search
CPC ..... G03G 15/0225; G03G 15/0233; G03G 15/095; G03G 15/11; G03G 15/161; G03G 15/168; G03G 15/1685; G03G 15/206; G03G 21/105; G03G 21/1623; G03G 21/1671; G03G 21/169; G03G 2215/1661; G03G 2221/16
See application file for complete search history.

(56) References Cited

U.S. PATENT DOCUMENTS 4,231,653 A * 11/1980 Nagahara ..... G03G 15/2025 118/60
8,918,039 B2 12/2014 Arikawa et al.

FOREIGN PATENT DOCUMENTS

| | | | |
|---|---|---|---|
| JP | 2000-122505 | A | 4/2000 |
| JP | 2005-055502 | A | 3/2005 |
| JP | 2005-164717 | A | 6/2005 |
| JP | 2009-156995 | A | 7/2009 |
| JP | 2010-091657 | A | 4/2010 |
| JP | 2010-211096 | A | 9/2010 |
| JP | 2014-059391 | A | 4/2014 |

* cited by examiner

*Primary Examiner* — Roy Y Yi
(74) *Attorney, Agent, or Firm* — Oliff PLC

(57) ABSTRACT

A cleaning device includes a cleaning member and a collecting member. The cleaning member rotates while being in contact with a member to be cleaned that rotates or circulates, so that an object attached to the member to be cleaned is transferred to the cleaning member. The collecting member is made of a porous material having plural pores that are connected to each other, the collecting member rotating while being in contact with a surface of the cleaning member so that the object that has been transferred to the cleaning member is collected in the pores.

16 Claims, 10 Drawing Sheets

CLEANING DEVICE, COLLECTING MEMBER, FIXING DEVICE, AND IMAGE FORMING APPARATUS

CROSS-REFERENCE TO RELATED APPLICATIONS

This application is based on and claims priority under 35 USC 119 from Japanese Patent Application No. 2014-236510 filed Nov. 21, 2014.

BACKGROUND (i) Technical Field

The present invention relates to a cleaning device, a collecting member, a fixing device, and an image forming apparatus.

(ii) Related Art

Image forming apparatuses that perform so-called borderless printing are known. In borderless printing, an image is formed over the entire area of a sheet. In an image forming apparatus that forms an image over the entire area of a sheet, there is a possibility that toner on the peripheral edges of the sheet will adhere to a heat roller, a fixing belt, or the like of a fixing device.

SUMMARY

According to an aspect of the invention, there is provided a cleaning device including a cleaning member and a collecting member. The cleaning member rotates while being in contact with a member to be cleaned that rotates or circulates, so that an object attached to the member to be cleaned is transferred to the cleaning member. The collecting is member made of a porous material having plural pores that are connected to each other, the collecting member rotating while being in contact with a surface of the cleaning member so that the object that has been transferred to the cleaning member is collected in the pores.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described in detail with reference to the accompanying drawings.

Image Forming Apparatus

Figure 1:
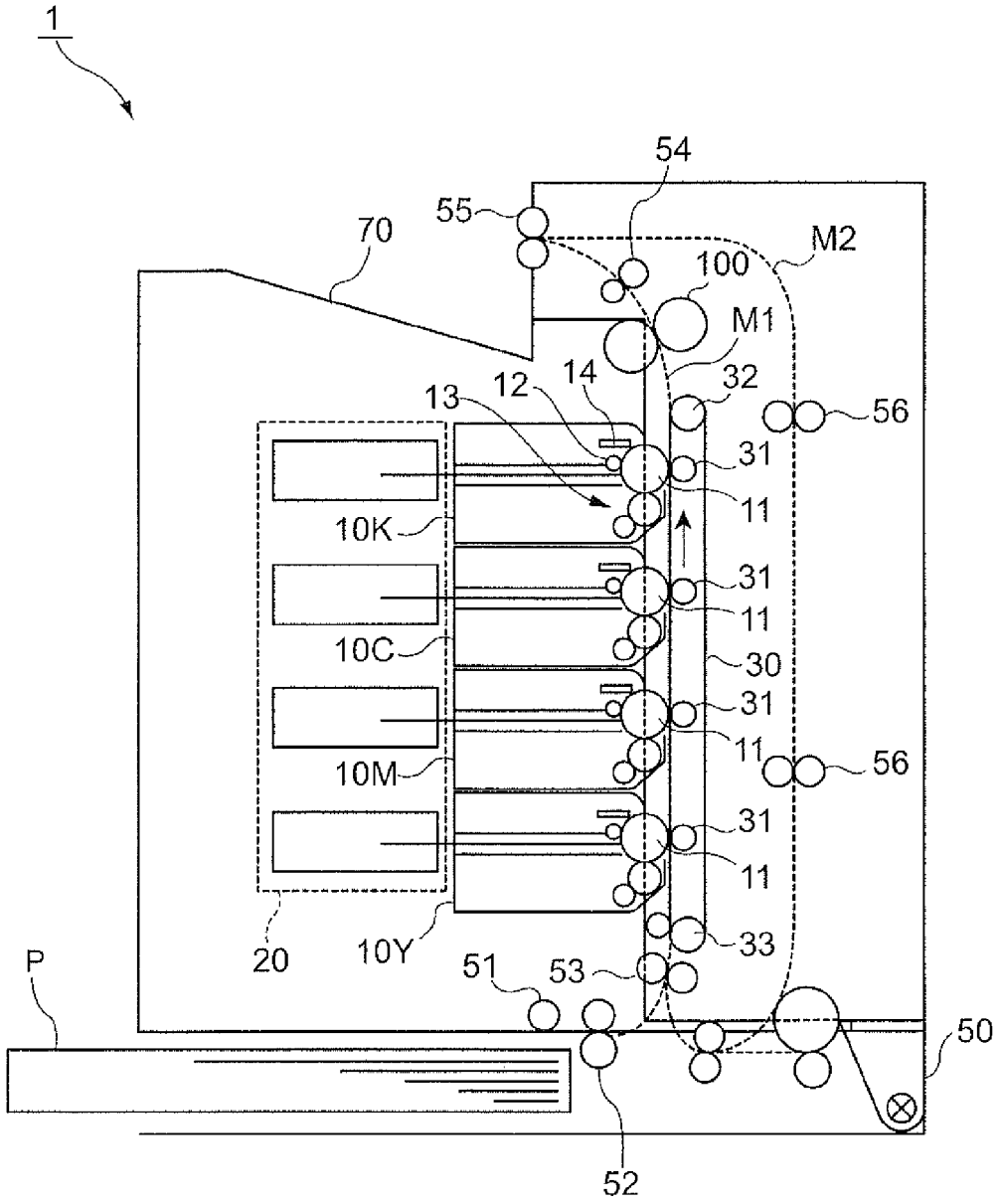
FIG. 1 illustrates the overall structure of an image forming apparatus according to an exemplary embodiment.

FIG. 1 illustrates the overall structure of an image forming apparatus 1 according to the exemplary embodiment. The image forming apparatus 1 illustrated in FIG. 1 has a so-called tandem structure in which four image forming units (process cartridges) 10Y, 10M, 10C, and 10K, which are examples of toner-image forming units, are arranged next to each other with gaps therebetween in an up-down (vertical) direction. Each of the process cartridges 10Y, 10M, 10C, and 10K includes a photoconductor drum 11, a charging roller 12, a developing device 13, and a drum cleaner 14, which are integrated with each other. The charging roller 12 uniformly charges a surface of the photoconductor drum 11 to a predetermined potential. The developing device 13 is an example of a developing member, and develops an electrostatic latent image, which is formed on the photoconductor drum 11, by using developer held by a developing roller. The developer contains toner (negatively charged) and carrier (magnetic particles). The drum cleaner 14 cleans the surface of the photoconductor drum 11 after a transfer process. In the present exemplary embodiment, the size of the process cartridges 10Y, 10M, 10C, and 10K in a rotational axis direction of the photoconductor drum 11 is greater than a width of sheets P in that direction.

The process cartridges 10Y, 10M, 10C, and 10K have similar structures expect for the toners contained in the respective developing devices 13. The process cartridges 10Y, 10M, 10C, and 10K respectively form yellow (Y), magenta (M), cyan (C), and black (K) toner images.

The process cartridges 10Y, 10M, 10C, and 10K are configured so as to be removably attachable to the body of the image forming apparatus 1. When, for example, the toners in the developing devices 13 are consumed, the process cartridges 10Y, 10M, 10C, and 10K may be individually replaced with new ones.

The image forming apparatus 1 according to the present exemplary embodiment includes a laser exposure device 20 as an example of an exposure system. The laser exposure device 20 irradiates the photoconductor drums 11 included in the process cartridges 10Y, 10M, 10C, and 10K with light. The laser exposure device 20 includes four semiconductor lasers that correspond to the photoconductor drums 11 included in the process cartridges 10Y, 10M, 10C, and 10K. The four semiconductor lasers of the laser exposure device 20 are turned on and driven on the basis of image data of each color, so that electrostatic latent images are formed on the photoconductor drums 11 of the process cartridges 10Y, 10M, 10C, and 10K.

The image forming apparatus 1 according to the present exemplary embodiment also includes a transport belt 30 that transports a sheet P, which is a recording medium (recording paper), so that the sheet P comes into contact with the photoconductor drums 11 of the process cartridges 10Y, 10M, 10C, and 10K. The transport belt 30 is a film-shaped endless belt capable of holding the sheet P by electrostatic attraction. The transport belt 30 is circulated while being stretched between a driving roller 32 and an idle roller 33, and forms a paper transport path M1, along which the sheet P is transported vertically upward, between the transport belt 30 and the photoconductor drums 11.

Transfer rollers 31, which are examples of transfer units, are disposed inside the transport belt 30 at positions where the transfer rollers 31 oppose the respective photoconductor drums 11. The transfer rollers 31 form transfer electric fields between the transfer rollers 31 and the respective photoconductor drums 11, so that the toner images of the respective colors formed by the process cartridges 10Y, 10M, 10C, and 10K are successively transferred onto the sheet P that is held and transported by the transport belt 30.

A fixing device 100, which performs a fixing process on the unfixed toner images on the sheet P by applying heat and pressure, is disposed on the downstream side of the transport belt 30 along the paper transport path M1. The structure of the fixing device 100 will be described in detail below.

The image forming apparatus 1 according to the present exemplary embodiment further includes a sheet transporting system including a paper cassette 50 that contains sheets P at a paper feeding side, a pickup roller 51 that picks up and feeds one of the sheets P contained in the paper cassette 50 at a predetermined timing, transport rollers 52 that transport the sheet P fed by the pickup roller 51, and registration rollers 53 that transport the sheet P toward the transport belt 30 in accordance with an image forming operation.

In the image forming apparatus 1 according to the present exemplary embodiment, the paper cassette 50 protrudes from the rear side of the body of the image forming apparatus 1, as illustrated in FIG. 1. The paper cassette 50 is capable of being pulled out of the body of the image forming apparatus 1 at the front side when, for example, new sheets P are to be supplied.

The image forming apparatus 1 according to the present exemplary embodiment further includes transport rollers 54 and transport rollers 55 at a sheet ejection side. The transport rollers 54 transport the sheet P that has been subjected to the fixing process by the fixing device 100. The transport rollers 55 eject the sheet P toward a paper output portion 70 provided in an upper section of the apparatus body when single-sided printing is performed. When double-sided printing is performed, the transport rollers 55 start to rotate in directions opposite to the rotating directions for ejecting the sheet P toward the paper output portion 70 at a predetermined timing, so that the sheet P that has been subjected to the fixing process by the fixing device 100 at one side thereof is transported to a double-sided-printing transport path M2. Transport rollers 56 that further transport the sheet P are arranged along the double-sided-printing transport path M2.

In the image forming apparatus 1 according to the present exemplary embodiment, the laser exposure device 20 generates laser beams that are modulated on the basis of image information, and forms electrostatic latent images on the photoconductor drums 11 of the process cartridges 10Y, 10M, 10C, and 10K. For example, in the yellow (Y) process cartridges 10Y, the surface of the photoconductor drum 11 that has been uniformly charged to a predetermined potential by the charging roller 12 is scanned with the corresponding laser beam generated by the laser exposure device 20, so that an electrostatic latent image is formed on the photoconductor drum 11. The electrostatic latent image is developed by the developing device 13, so that a yellow toner image is formed on the photoconductor drum 11. Similarly, magenta, cyan, and black toner images are formed on the process cartridges 10M, 10C, and 10K.

When the process cartridges 10Y, 10M, 10C, and 10K start forming the toner images of the respective colors, the sheet P fed from the paper cassette 50 is supplied to the transport belt 30 by the registration rollers 53 at a timing corresponding to the timing at which the toner images are formed. The sheet P is transported along the paper transport path M1 while being electrostatically attracted to the transport belt 30, which circulates in the direction shown by the arrow in FIG. 1. The toner images of the respective colors are successively transferred onto the sheet P in a superposed manner by the transfer electric fields formed by the transfer rollers 31.

The sheet P onto which the toner images have been electrostatically transferred is separated from the transport belt 30 at a position on the downstream side of the process cartridges 10K, and is transported to the fixing device 100. When the sheet P reaches the fixing device 100, the unfixed toner images on the sheet P are subjected to the fixing process in which heat and pressure are applied, and are thereby fixed to the sheet P. The sheet P to which the toner images are fixed is ejected to the paper output portion 70 included in an output section of the image forming apparatus 1. In the case where double-sided printing is performed, the sheet P is transported along the double-sided-printing transport path M2, subjected to a similar transfer process, and is ejected to the paper output portion 70.

The image forming apparatus 1 according to the present exemplary embodiment performs borderless printing in which an image is formed over the entire area of the sheet P. In other words, in the image forming apparatus 1 according to the present exemplary embodiment, the toner images are formed so as to extend from one edge to the other edge of the sheet P in the width direction of the sheet P, and from one edge to the other edge of the sheet P in the direction in which the sheet P is transported.

Fixing Device

The fixing device 100 according to the present exemplary embodiment will now be described.

Figure 2:
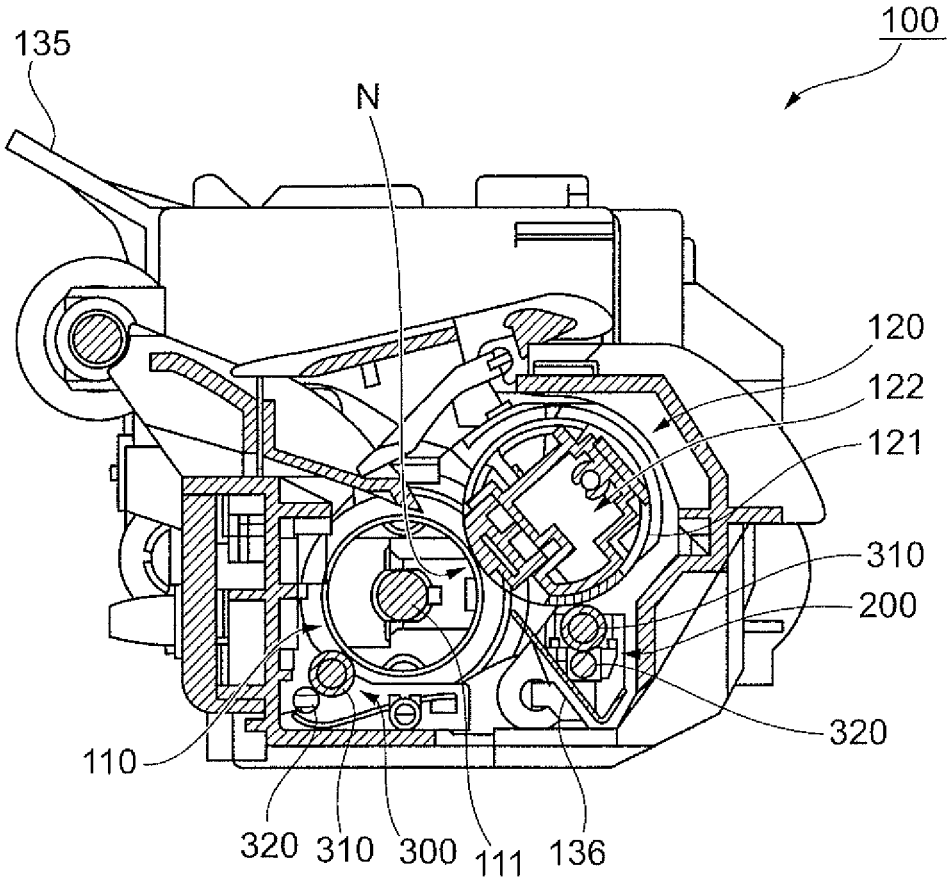
FIG. 2 is a schematic diagram illustrating the structure of a fixing device according to the exemplary embodiment.
Figure 3:
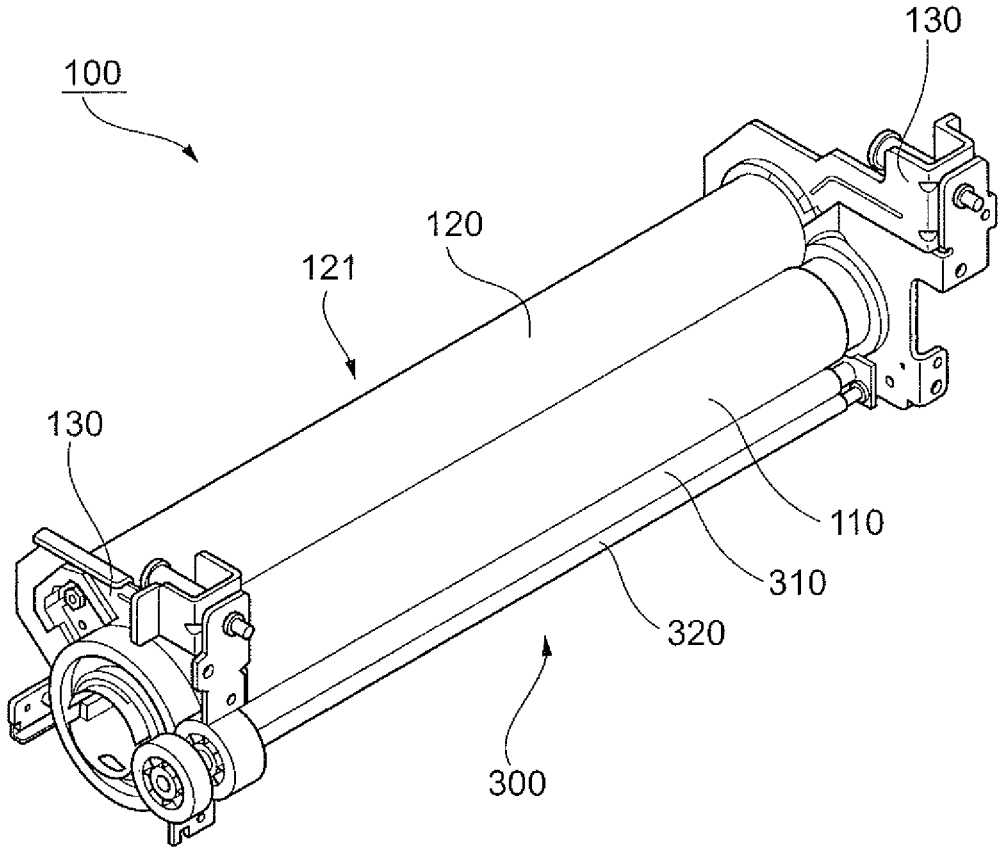
FIG. 3 is another schematic diagram illustrating the structure of the fixing device according to the exemplary embodiment.

FIG. 2 is a schematic diagram illustrating the structure of the fixing device 100 according to the present exemplary embodiment, and corresponds to a sectional view of the fixing device 100 taken along a transporting direction in which the sheet P is transported. FIG. 3 is another schematic diagram illustrating the structure of the fixing device 100 according to the present exemplary embodiment, and corresponds to a perspective view of the fixing device 100.

The fixing device 100 according to the present exemplary embodiment includes a heat roller 110 and a fixing member 120 that opposes the heat roller 110. The fixing device 100 further includes frames 130 that support the heat roller 110 and the fixing member 120, and a switching lever 135 that switches a state of contact between the heat roller 110 and the fixing member 120. In addition, as illustrated in FIG. 2, the fixing device 100 further includes a guide member 136 that guides the transported sheet P to a nip section N formed between the heat roller 110 and the fixing member 120.

In the fixing device 100 according to the present exemplary embodiment, the heat roller 110 and the fixing member 120 function as a pair of fixing members.

The fixing device 100 according to the present exemplary embodiment further includes a cleaning device 200 that cleans a surface of a fixing belt 121 of the fixing member 120, which will be described below, and a cleaning device 300 that cleans a surface of the heat roller 110.

The fixing device 100 according to the present exemplary embodiment is structured such that the state thereof may be switched between a pressing state and a released state by the switching lever 135. In the pressing state, the heat roller 110 is pressed by the fixing member 120, and the nip section N is formed between the heat roller 110 and the fixing member 120. In the released state, the pressing force applied to the heat roller 110 by the fixing member 120 is eliminated, and the heat roller 110 and the fixing member 120 are separated from each other. Accordingly, unlike the case in which this structure is not provided, when, for example, a paper jam occurs in the fixing device 100, the fixing device 100 may be switched to the released state, so that the jammed sheet P may be easily removed from the fixing device 100. In FIG. 2, the fixing device 100 is in the pressing state.

The heat roller 110 according to the present exemplary embodiment is an example of a member to be cleaned, and the original shape thereof is cylindrical. The heat roller 110 is elastically deformable, and is structured such that the cylindrical shape thereof is maintained owing to its own rigidity. The heat roller 110 according to the present exemplary embodiment is rotatable. The material of the heat roller 110 may be, for example, nickel steel, stainless steel, nickel-cobalt alloy, copper, gold, or nickel-iron alloy. To increase the releasability of the sheet P from the heat roller 110, a surface layer made of a fluoropolymer or the like that has a high releasability may be provided at the outer periphery of the heat roller 110.

A heater 111 for heating the heat roller 110 is disposed in the heat roller 110. The heater 111 may be, for example, a halogen lamp.

The fixing member 120 includes the endless fixing belt 121 that opposes the heat roller 110 and that is rotatable, and a pressing device 122 that is disposed inside the fixing belt 121 and presses the heat roller 110 with the fixing belt 121 interposed therebetween in the pressing state.

The fixing belt 121 is another example of a member to be cleaned, and includes a base layer formed of a sheet-shaped member having a high heat resistance, an elastic layer stacked on the base layer, and a surface release layer that is stacked on the elastic layer and exposed at the outer periphery of the fixing belt 121. The base layer, the elastic layer, and the surface release layer are arranged in that order from the inner side.

In the fixing device 100 according to the present exemplary embodiment, the heat roller 110 is rotated in one direction (counterclockwise in FIG. 2) at a predetermined speed by a driving force applied by a drive motor (not shown). The fixing belt 121, which is in contact with the heat roller 110, is rotated in one direction (clockwise in FIG. 2) by the heat roller 110 that rotates. Thus, the fixing belt 121 receives a rotating force from the heat roller 110, and is rotated in response to the rotation of the heat roller 110.

The frames 130 are provided at the ends of the fixing device 100 in the width direction so as to oppose each other with the heat roller 110 and the fixing member 120 disposed therebetween. The frames 130 support the heat roller 110 and the fixing member 120 in a rotatable manner at both ends of the heat roller 110 and the fixing member 120 in the width direction.

Cleaning Device

The structures of the cleaning devices 200 and 300 according to the present exemplary embodiment will now be described. The cleaning device 200, which cleans the surface of the fixing belt 121, and the cleaning device 300, which cleans the surface of the heat roller 110, have the same structure. Therefore, the cleaning device 300, which cleans the surface of the heat roller 110, will be described as an example.

Figure 4:
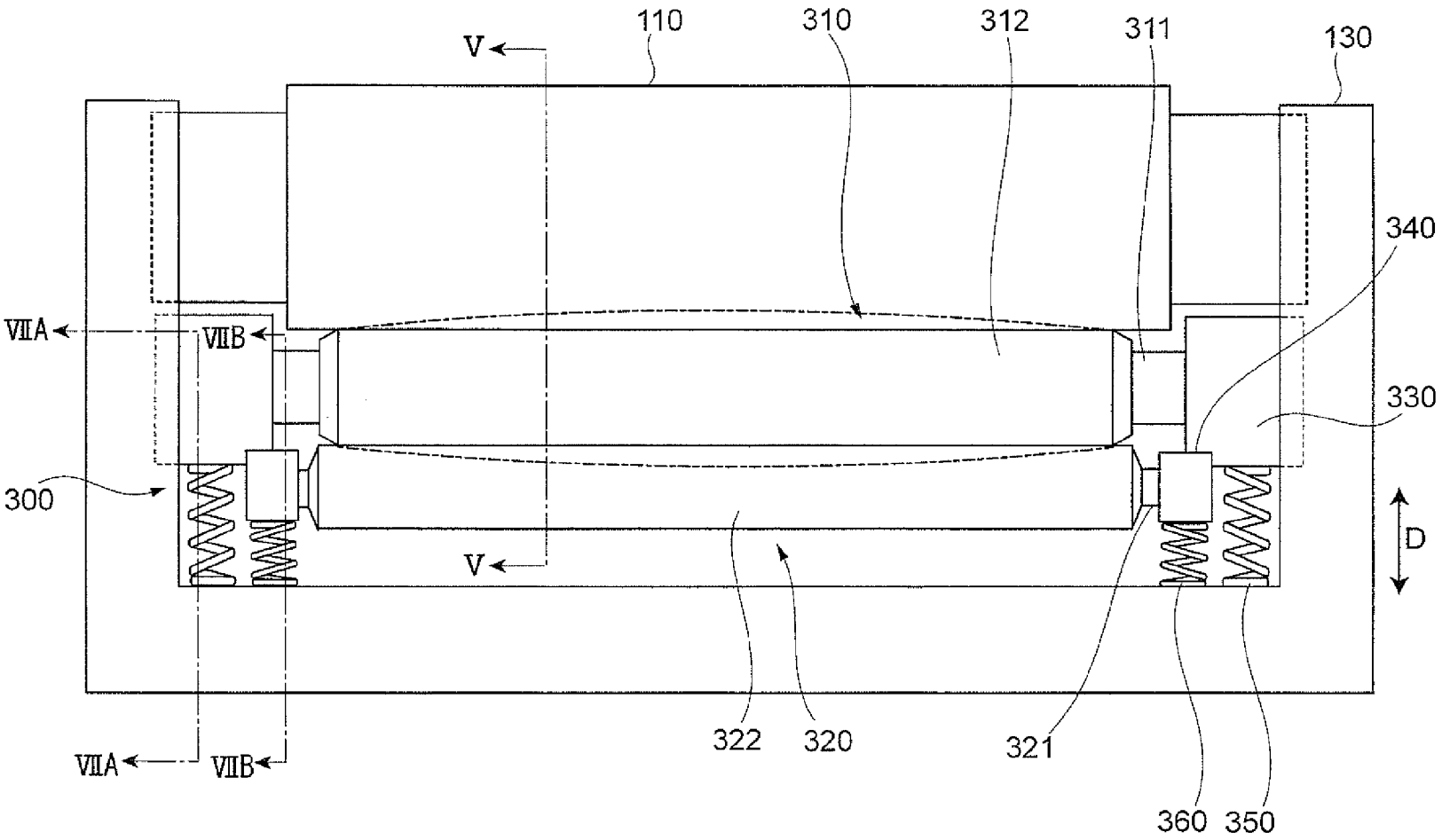
FIG. 4 illustrates an example of structures of a cleaning device and a heat roller according to the exemplary embodiment.
Figure 5:
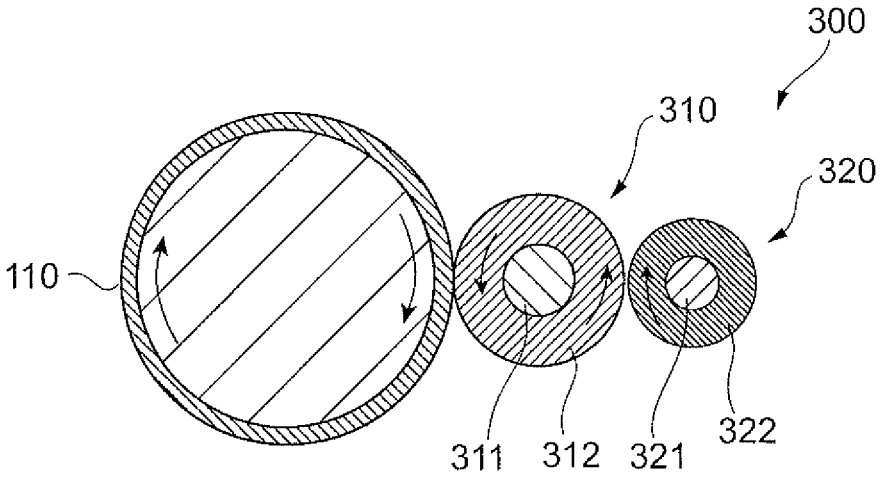
FIG. 5 is a sectional view of FIG. 4 taken along line V-V.

FIG. 4 illustrates an example of structures of the cleaning device 300 and the heat roller 110 according to the present exemplary embodiment. FIG. 5 is a sectional view of FIG. 4 taken along line V-V.

Referring to FIGS. 4 and 5, the cleaning device 300 according to the present exemplary embodiment includes a cleaning roller 310, which is an example of a cleaning member or a member from which an object is to be collected. The cleaning roller 310 is in contact with the surface of the heat roller 110, and cleans the surface of the heat roller 110 by causing toner, which is an example of an object attached to the surface of the heat roller 110, to be transferred to the cleaning roller 310. The cleaning device 300 also includes a collecting roller 320, which is an example of a collecting member. The collecting roller 320 is in contact with the surface of the cleaning roller 310, and cleans the cleaning roller 310 by collecting the toner that has been transferred from the heat roller 110 to the surface of the cleaning roller 310. In the cleaning device 200 (see FIG. 2), the cleaning roller 310 is in contact with the surface of the fixing belt 121, and cleans the surface of the fixing belt 121 by causing the toner attached to the surface of the fixing belt 121 to be transferred to the cleaning roller 310.

The cleaning device 300 further includes first bearings 330 that are provided at both ends of the cleaning roller 310 and support the cleaning roller 310 in a rotatable manner, and second bearings 340 that are provided at both ends of the collecting roller 320 and support the collecting roller 320 in a rotatable manner.

The cleaning device 300 further includes first spring members 350 that press the cleaning roller 310 against the heat roller 110 through the first bearings 330, and second spring members 360 that press the collecting roller 320 against the cleaning roller 310 through the second bearings 340.

Cleaning Roller and Collecting Roller

The cleaning roller 310 according to the present exemplary embodiment includes a solid columnar shaft 311 made of, for example, a metal such as stainless steel or iron, and an elastic layer 312 that is provided at the outer periphery of the shaft 311 and made of a heat resistant material that is elastically deformable when pressed. The material of the elastic layer 312 may be, for example, a heat resistant rubber, such as silicone rubber or fluorocarbon rubber. The elastic layer 312 may have a rubber hardness of about 15 of more in terms of JIS-A hardness.

As shown by the one-dot chain lines in FIG. 4, the original shape of the elastic layer 312 of the cleaning roller 310 in the state in which the elastic layer 312 is not in contact with the heat roller 110 or the collecting roller 320 is a so-called crown shape in which the outer diameter gradually decreases from the center toward the ends in the width direction (rotational axis direction).

In the present exemplary embodiment, when the fixing operation is performed by the fixing device 100, the cleaning roller 310 receives a rotational driving force from the heat roller 110 and is rotated in response to the rotation of the heat roller 110.

The collecting roller 320 according to the present exemplary embodiment includes a solid columnar shaft 321, which is an example of a support member and which is made of, for example, a metal such as stainless steel or iron, and a porous layer 322 that is provided at the outer periphery of the shaft 321 and made of a porous material having a continuous foam structure including multiple pores that are connected to each other. The material of the porous layer 322 of the collecting roller 320 has a rigidity higher than that of the material of the elastic layer 312 of the cleaning roller 310. The material of the porous layer 322 may be, for example, a porous metal made of stainless steel, iron, or the like, or a porous ceramic material made of aluminum oxide, silicon carbide, or the like. Considering the strength, heat resistance, etc., of the porous layer 322, a porous metal may be used as the material of the porous layer 322. As illustrated in FIG. 4, the porous layer 322 of the collecting roller 320 has a so-called straight shape in which the outer diameter is constant from one end to the other. The detailed structure of the porous layer 322 of the collecting roller 320 will be described in detail below.

In the present exemplary embodiment, when the fixing operation is performed by the fixing device 100, the collecting roller 320 receives a rotational driving force from the cleaning roller 310, which is rotated in response to the rotation of the heat roller 110, and is thereby rotated in response to the rotations of the heat roller 110 and the cleaning roller 310.

Figure 6:
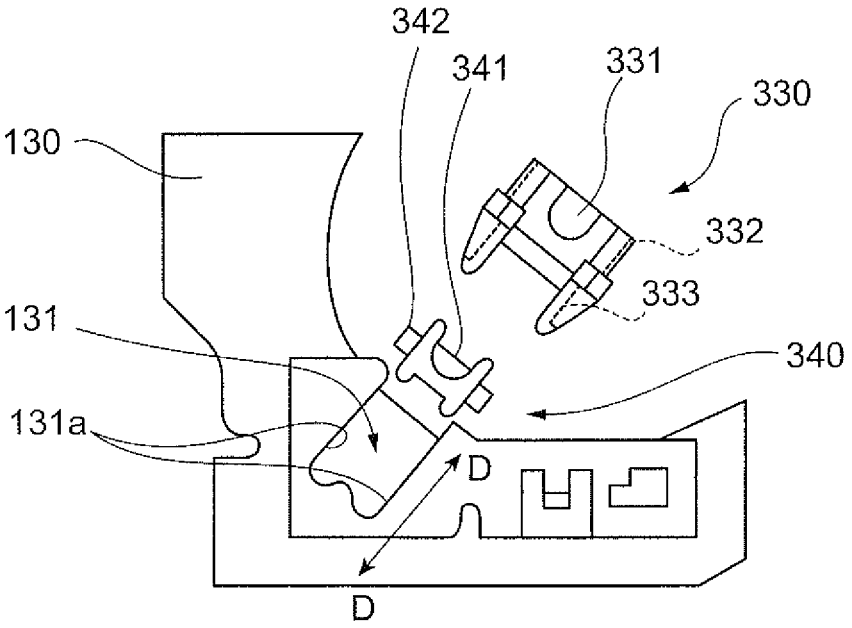
FIG. 6 is an exploded perspective view illustrating the relationship between a frame, a first bearing, and a second bearing.
Figure 7A:
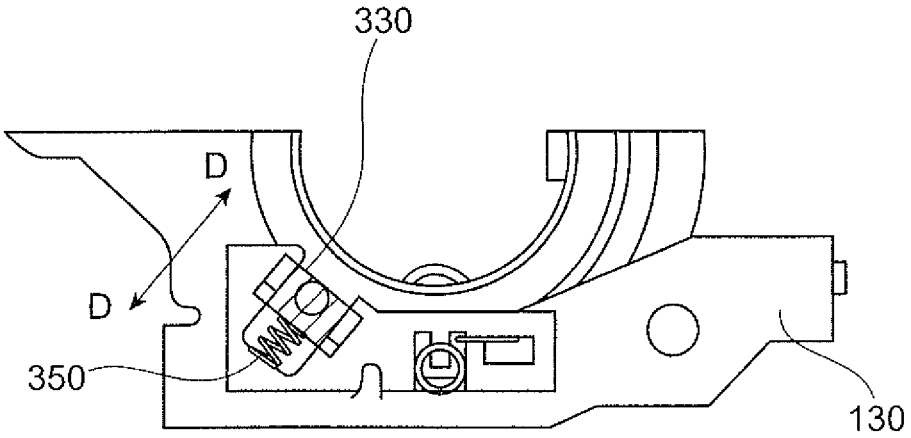
FIGS. 7A and 7B illustrate the relationship between a first spring member, a second spring member, the frame, the first bearing, and the second bearing.
Figure 7B:
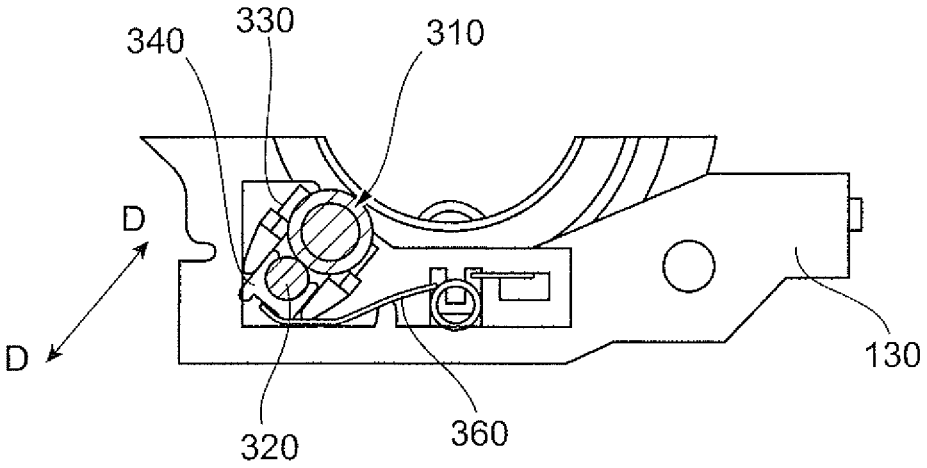

FIG. 6 is an exploded perspective view illustrating the relationship between the frame 130, the first bearing 330, and the second bearing 340 at each end of the cleaning device 300 in the width direction. FIGS. 7A and 7B are diagrams illustrating the relationship between the first spring member 350, the second spring member 360, the frame 130, the first bearing 330, and the second bearing 340 at each end of the cleaning device 300 in the width direction. FIG. 7A corresponds to a sectional view taken along line VIIA-VIIA in FIG. 4, and FIG. 7B corresponds to a sectional view taken along line VIIB-VIIB in FIG. 4.

As illustrated in FIG. 6, at each end of the cleaning device 300 (see FIG. 3) according to the present exemplary embodiment, the first bearing 330 is supported so as to be slidable with respect to the frame 130 of the fixing device 100 (see FIG. 2) in the direction of arrow D. In addition, the second bearing 340 is supported so as to be slidable with respect to the first bearing 330 and the frame 130 in the direction of arrow D. The direction of arrow D is the direction of a straight line that passes through the rotational centers of the cleaning roller 310, the collecting roller 320, and the heat roller 110 in the state in which the cleaning device 300 is installed in the fixing device 100.

More specifically, in the present exemplary embodiment, as illustrated in FIG. 6, the frame 130 has a cut 131 in the area between two sides 131*a* that extend in the direction of arrow D.

The first bearing 330 includes a first support portion 331 that supports the corresponding end portion of the shaft 311 (see FIG. 5) of the cleaning roller 310 in a rotatable manner. The first support portion 331 is a cut having an arc shape that matches the shape of the outer periphery of the shaft 311. As illustrated in FIG. 6, the first bearing 330 has grooves 332 that receive the sides 131*a* of the cut 131 formed in the frame 130. The grooves 332 slide along the sides 131*a* of the cut 131, thereby enabling the first bearing 330 to slide with respect to the frame 130 in the direction of arrow D. The first bearing 330 further includes grooves 333 that receive projections 342 of the second bearing 340, which will be described below.

As illustrated in FIG. 7A, the first bearing 330 is attached to the frame 130 in such a state that the first spring member 350, which is a compression spring or the like, is provided between the first bearing 330 and the frame 130. Accordingly, the first bearing 330 is pressed in the direction of arrow D by the elastic force of the first spring member 350. As a result, the cleaning roller 310 (see FIG. 4), which is supported by the first bearing 330, is pressed against the heat roller 110 in the direction of arrow D.

When the cleaning roller 310 is pressed against the heat roller 110, the elastic layer 312 is elastically deformed. Accordingly, a contact area is formed between the elastic layer 312 of the cleaning roller 310 and the heat roller 110, the contact area having a width in the circumferential direction of the cleaning roller 310 and the heat roller 110.

The second bearing 340 includes a second support portion 341 that supports the corresponding end portion of the shaft 321 (see FIG. 5) of the collecting roller 320 in a rotatable manner. The second support portion 341 is a cut having an arc shape that matches the shape of the outer periphery of the shaft 321. As illustrated in FIG. 6, the second bearing 340 also includes projections 342 that are inserted into the grooves 333 formed in the first bearing 330. The projections 342 slide along the grooves 333 in the first bearing 330, thereby enabling the second bearing 340 to slide with respect to the first bearing 330 in the direction of arrow D.

As illustrated in FIG. 7B, the second bearing 340 is attached to the frame 130 in such a state that the second spring member 360, which is a torsion spring or the like, is provided between the second bearing 340 and the frame 130. Accordingly, the second bearing 340 is pressed in the direction of arrow D by the elastic force of the second spring member 360. As a result, the collecting roller 320 (see FIG. 4), which is supported by the second bearing 340, is pressed against the cleaning roller 310 in the direction of arrow D.

As described above, the rigidity of the porous layer 322 of the collecting roller 320 is higher than that of the elastic layer 312 of the cleaning roller 310. Therefore, when the collecting roller 320 is pressed against the cleaning roller 310, the elastic layer 312 of the cleaning roller 310 is elastically deformed. Accordingly, a contact area is formed between the elastic layer 312 of the cleaning roller 310 and the porous layer 322 of the collecting roller 320, the contact area having a width in the circumferential direction of the cleaning roller 310 and the collecting roller 320.

As described above, in the cleaning roller 310 according to the present exemplary embodiment, the elastic layer 312 has a so-called crown shape. Accordingly, compared to the case in which the elastic layer 312 has a straight shape, the state in which the heat roller 110 and the cleaning roller 310 are in contact with each other may be maintained more appropriately.

More specifically, the image forming apparatus 1 (see FIG. 1) according to the present exemplary embodiment is configured so as to be capable of forming images on different types of sheets P having different sizes. In the fixing device 100 of the present exemplary embodiment, heat is transferred from the heat roller 110 to each sheet P in the nip section N formed between the heat roller 110 and the fixing belt 121, so that the toner images are fixed to the sheet P. Therefore, in the case where, for example, an image is formed on a sheet P having a small width, although heat is transferred from the heat roller 110 to the sheet P in a central region of the nip section N in the width direction, heat is not easily transferred from the heat roller 110 to the sheet P in regions that are near the ends of the nip section N in the width direction and through which the sheet P is not transported. As a result, the end portions of the heat roller 110 in the width direction are heated and thermally expand more easily than the central portion of the heat roller 110 in the width direction. In this case, the shape of the heat roller 110 changes to a reverse crown shape in which the outer diameter increases from the center toward the ends in the width direction.

According to the present exemplary embodiment, the cleaning roller 310 that is in contact with the heat roller 110 has a crown shape. Therefore, even when the heat roller 110 is deformed due to thermal expansion, a larger contact area is provided between the heat roller 110 and the cleaning roller 310 than in the case where the cleaning roller 310 has a straight shape. As a result, in a cleaning operation performed by the cleaning device 300, the toner attached to the heat roller 110 is more easily transferred to the elastic layer 312 of the cleaning roller 310.

In the cleaning device 300 according to the present exemplary embodiment, the direction in which the first spring member 350 urges the cleaning roller 310 toward the heat roller 110 is the same as the direction in which the second spring member 360 urges the collecting roller 320 toward the cleaning roller 310.

Thus, the cleaning roller 310 is pressed against the heat roller 110 not only by the urging force of the first spring member 350 but also by the urging force of the second spring member 360 applied through the collecting roller 320. As a result, in the present exemplary embodiment, the force that urges the cleaning roller 310 against the heat roller 110 is greater than the force that urges the collecting roller 320 against the cleaning roller 310.

Accordingly, compared to the case in which, for example, the relationship between the urging forces applied to the cleaning roller 310 and the collecting roller 320 is opposite to that described above, the risk that the rotation of the cleaning roller 310 in response to the rotation of the heat roller 110 will be impeded may be reduced. Thus, the cleaning roller 310 is reliably rotated by the rotation of the heat roller 110, and the collecting roller 320 is reliably rotated by the rotation of the cleaning roller 310, which is rotated by the rotation of the heat roller 110. As a result, in the cleaning operation, the toner may be appropriately transferred from the heat roller 110 to the cleaning roller 310, and from the cleaning roller 310 to the collecting roller 320.

In the case where the force that urges the collecting roller 320 against the cleaning roller 310 is greater than the force that urges the cleaning roller 310 against the heat roller 110, it is difficult for the collecting roller 320 to rotate by receiving a driving force from the cleaning roller 310.

In the cleaning device 300 according to the present exemplary embodiment, the urging direction of the first spring member 350 is the same as the urging direction of the second spring member 360. Therefore, compared to the case in which the urging directions are different, the total urging force required to press the cleaning roller 310 and the collecting roller 320 is reduced. In other words, small springs may be used as the first spring member 350 and the second spring member 360, so that the size of the cleaning device 300 may be reduced.

Porous Layer

The structure of the porous layer 322 of the collecting roller 320 will now be described.

Figure 8A:
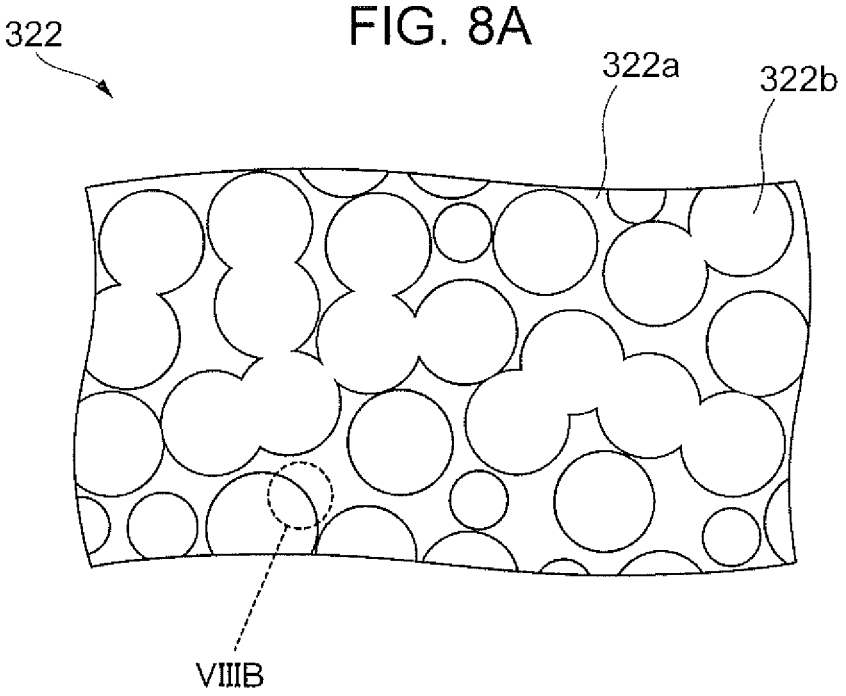
FIG. 8A illustrates a surface of a porous layer according to the exemplary embodiment.
Figure 8B:
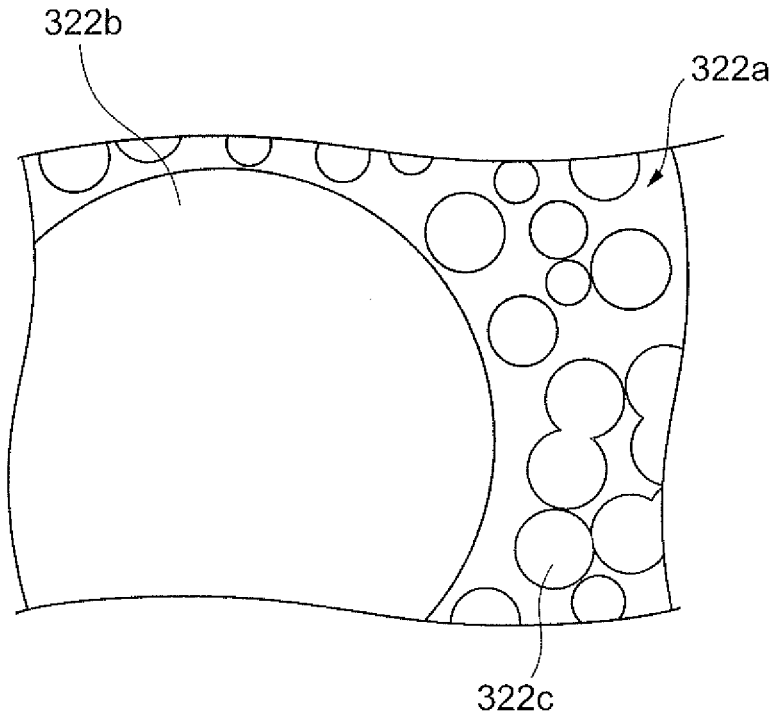
FIG. 8B is an enlarged view of part VIIIB in FIG. 8A.
Figure 9:
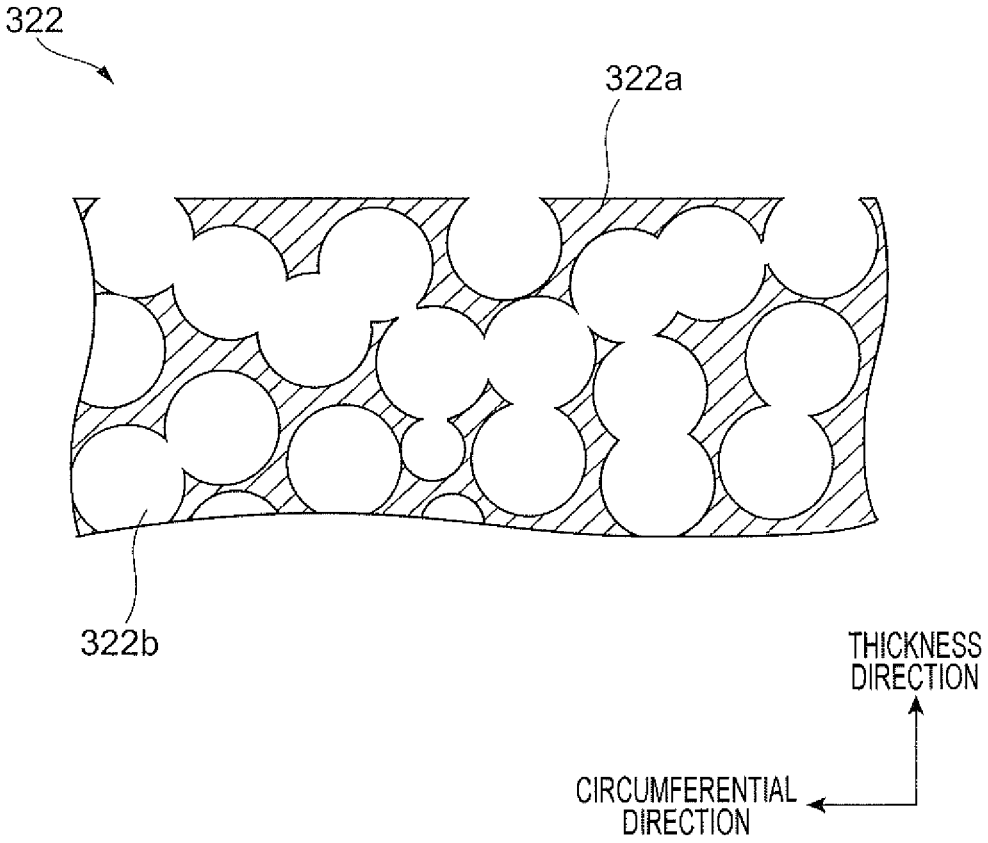
FIG. 9 is a sectional view of the porous layer taken along the thickness direction.

FIG. 8A illustrates the surface (outer peripheral surface) of the porous layer 322 according to the present exemplary embodiment. FIG. 8B is an enlarged view of part VIIIB in FIG. 8A. FIG. 9 is a sectional view of the porous layer 322 taken along a thickness direction (direction perpendicular to the rotational axis direction of the collecting roller 320). In FIG. 9, the upper surface of the porous layer 322 corresponds to the surface that opposes the cleaning roller 310 (see FIG. 4).

As described above, the porous layer 322 according to the present exemplary embodiment is made of a porous material having a continuous foam structure. More specifically, as illustrated in FIGS. 8A and 9, the porous layer 322 includes a continuous skeletal structure 322*a* and multiple pores 322*b* surrounded by the skeletal structure 322*a*. In the collecting roller 320 according to the present exemplary embodiment, the toner that has been transferred from the heat roller 110 to the cleaning roller 310 is received by the pores 322*b* in the porous layer 322. This will be described in more detail below.

As illustrated in FIGS. 8A and 9, in the porous layer 322 according to the present exemplary embodiment, the pores 322*b* open in the surface of the porous layer 322. In other words, in the porous layer 322, the inner spaces of the pores 322*b* communicate with the space outside the collecting roller 320.

Accordingly, in the cleaning operation performed by the cleaning device 300, which will be described below, the toner attached to the surface of the cleaning roller 310 (see FIG. 4) enters the pores 322*b* from the surface of the porous layer 322, and is received by the pores 322*b*.

In addition, as illustrated in FIG. 9, the pores 322*b* formed in the porous layer 322 are connected to each other in the thickness direction of the porous layer 322 and the planar direction of the porous layer 322 (circumferential direction of the collecting roller 320).

Thus, the toner that has entered the pores 322*b* from the surface of the porous layer 322 moves through the pores 322*b* that are connected to each other, and is pushed toward the inner periphery of the porous layer 322 (toward the shaft 321).

In addition, as illustrated in FIG. 8B, in the porous layer 322 according to the present exemplary embodiment, small pores 322*c*, which have a diameter smaller than that of the pores 322*b*, are formed in the skeletal structure 322*a*. In other words, in the porous layer 322 according to the present exemplary embodiment, the entire body of the porous layer 322 has a continuous foam structure in which the pores 322*b* are formed in the skeletal structure 322*a* so as to communicate with each other, and the skeletal structure 322*a* itself also has a continuous foam structure in which the small pores 322*c* are formed so as to communicate with each other.

Accordingly, the inner peripheral surface of each pore 322*b* has irregularities formed of the small pores 322*c*, so that the toner received by the pore 322*b* may be easily held in the pore 322*b*.

In the collecting roller 320 according to the present exemplary embodiment, the porosity of the porous layer 322 (volume porosity, which is the percentage of the volume of the pores 322*b* in the total volume of the porous layer 322) may be in the range of 50% to 97% or about 50% to 97%. When the porosity of the porous layer 322 is less than 50% or about 50%, the amount of toner receivable by the pores 322*b* in the porous layer 322 is small. In this case, the life span of the collecting roller 320 may be reduced. When the porosity of the porous layer 322 is higher than 97% or about 97%, the strength of the porous layer 322 may be too low and it may be difficult to strongly press the collecting roller 320 against the cleaning roller 310. In this case, the width of the contact area between the cleaning roller 310 and the collecting roller 320 may be too small, and it may be difficult to push the toner collected from the surface of the cleaning roller 310 toward the inner region of the porous structure of the porous layer 322.

In the collecting roller 320 according to the present exemplary embodiment, the average diameter of the pores 322*b* formed in the porous layer 322 may be in the range of 5 μm to 1000 μm or about 5 μm to 1000 μm. When the average diameter of the pores 322*b* is less than 5 μm or about 5 μm, the toner cannot easily enter the pores 322*b*. Therefore, there is a risk that the toner will remain on the surface of the cleaning roller 310. In this case, the toner may return to the surface of the heat roller 110 from the cleaning roller 310, and may adhere to the fixing belt 121 or the sheet P. When the average diameter of the pores 322*b* is greater than 1000 μm or about 1000 μm, the contact area between the porous layer 322 and the toner may be too small, and the toner cannot be easily pushed into the pores 322*b* in the porous layer 322. In addition, when the average diameter of the pores 322*b* is greater than 1000 μm or about 1000 μm, there is a risk that the toner that has entered the pores 322*b* will come out of the pores 322*b* and adhere to the cleaning roller 310 again.

In the collecting roller 320 according to the present exemplary embodiment, the surface opening ratio of the porous layer 322 may be in the range of 50% to 97% or about 50% to 97% in terms of area ratio. Here, the surface opening ratio is the percentage of the total area of the pores 322*b* in the outer peripheral surface of the porous layer 322 in the total area of the outer peripheral surface of the porous layer 322.

When the surface opening ratio is less than 50%, the toner cannot easily enter the pores 322*b*. Therefore, there is a risk that the toner will remain on the surface of the cleaning roller 310. When the surface opening ratio is higher than 97%, the contact area between the skeletal structure 322*a* of the porous layer 322 and the toner may be too small, and the toner cannot be easily pushed into the pores 322*b* in the porous layer 322.

The average diameter of the pores 322*b* in the porous layer 322 and the surface opening ratio of the porous layer 322 may be measured by, for example, analyzing an electron microscopic image of the surface of the porous layer 322.

Fixing Operation

The fixing operation performed by the fixing device 100 will now be described.

When the image forming operation is performed by the image forming apparatus 1 (see FIG. 1), the fixing device 100 is switched to the pressing state in which the nip section N is formed between the heat roller 110 and the fixing member 120. When the process cartridges 10Y, 10M, 10C, and 10K start the operation of forming the toner images, electric power is supplied to the heater 111 included in the heat roller 110 and the drive motor (not shown) that drives the heat roller 110. Accordingly, the heat roller 110 is heated and rotated, and the fixing belt 121 of the fixing member 120 is rotated by the rotation of the heat roller 110. The heat roller 110 is heated to a predetermined temperature, and the fixing belt 121 is heated through the heat roller 110.

Next, the sheet P to which the toner images of the respective colors have been transferred by the respective transfer rollers 31 is guided by the guide member 136 so as to be transported to the nip section N between the heat roller 110 and the fixing belt 121 of the fixing member 120. The sheet P that has been transported to the nip section N receives the heat transferred thereto from the heat roller 110 and the fixing belt 121, and the pressure applied between the heat roller 110 and the fixing belt 121 in the nip section N. As a result, the toner images are fixed to the sheet P.

Next, the sheet P to which the toner images have been fixed in the nip section N is separated from the heat roller 110 and the fixing belt 121, and is ejected to the paper output portion 70.

Cleaning Operation

Next, the cleaning operation performed by the cleaning device 300 when the fixing operation is performed by the fixing device 100 will be described.

As described above, the image forming apparatus 1 according to the present exemplary embodiment performs borderless printing in which an image is formed over the entire area of the sheet P. When borderless printing is performed, the toner may be supplied to a region outside the sheet P and adhere to the peripheral edges of the sheet P. More specifically, for example, the toner may adhere to the front and rear edges of the sheet P in the transporting direction and both edges of the sheet P in the width direction. The toner that has adhered to the peripheral edges of the sheet P may adhere to the surfaces of the heat roller 110 and the fixing belt 121 instead of being fixed to the sheet P in the nip section N.

When the next sheet P is transported to the nip section N in the state in which the toner is present on the surfaces of the heat roller 110 and the fixing belt 121, there is a risk that streaks or blotches will be formed on the sheet P due to the toner on the heat roller 110 and the fixing belt 121.

Accordingly, in the fixing device 100 according to the present exemplary embodiment, as described above, the cleaning device 200 for cleaning the surface of the fixing belt 121 and the cleaning device 300 for cleaning the surface of the heat roller 110 are provided. Thus, the toner that has adhered to the heat roller 110 and the fixing belt 121 is removed, and the risk that streaks or blotches will be formed on the sheet P is reduced.

FIGS. 10A to 10D are schematic diagrams illustrating the cleaning operation performed by the cleaning device 300. Although an operation of cleaning the surface of the heat roller 110 with the cleaning device 300 will be described, an operation of cleaning the surface of the fixing belt 121 with the cleaning device 200 is performed in a similar manner.

Figure 10A:
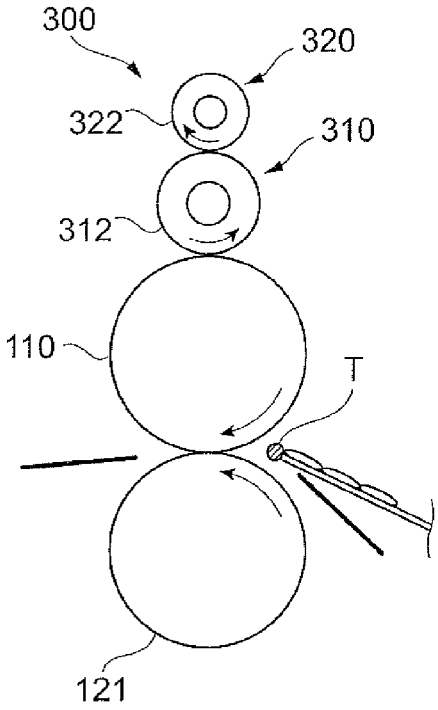
FIGS. 10A to 10D are schematic diagrams illustrating a cleaning operation performed by the cleaning device.
Figure 10B:
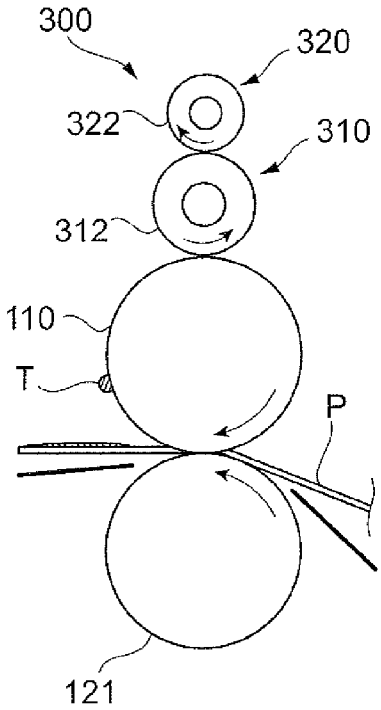

As illustrated in FIGS. 10A and 10B, toner T on the front edge of the sheet P in the transporting direction may, for example, adhere to the heat roller 110 instead of being fixed to the sheet P in the nip section N. Owing to the rotation of the heat roller 110, the toner T that has adhered to the heat roller 110 is moved to the position where the heat roller 110 and the cleaning roller 310 of the cleaning device 300 oppose each other.

As described above, in the fixing operation, the heat roller 110 is heated to a predetermined temperature by the heater 111. Accordingly, the toner T that has adhered to the heat roller 110 is heated and melted by the heat from the heat roller 110 while being moved toward the position where the heat roller 110 and the cleaning roller 310 oppose each other.

Figure 10C:
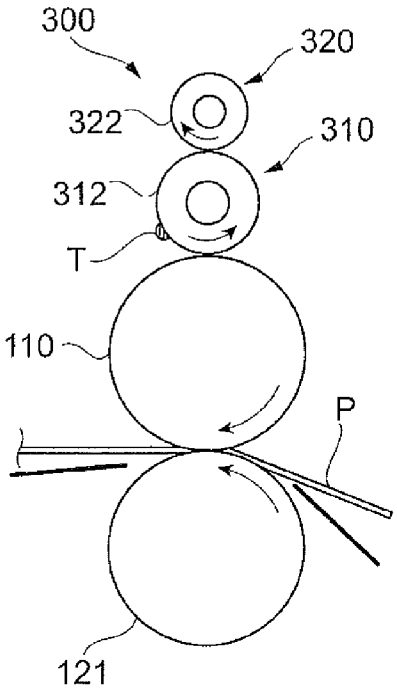

When the toner T in the molten state on the surface of the heat roller 110 reaches the position where the heat roller 110 and the cleaning roller 310 oppose each other, the toner T is transferred from the heat roller 110 to the elastic layer 312 of the cleaning roller 310, as illustrated in FIG. 10C.

Owing to the rotation of the cleaning roller 310, the toner that has been transferred from the heat roller 110 to the cleaning roller 310 is moved to the position where the cleaning roller 310 and the collecting roller 320 oppose each other. As described above, the elastic layer 312 of the cleaning roller 310 is in contact with the surface of the heat roller 110. Therefore, the elastic layer 312 of the cleaning roller 310 is heated by the heat transferred from the heat roller 110. Accordingly, the toner T that has been transferred from the heat roller 110 to the cleaning roller 310 is in the molten state while being moved toward the position where the cleaning roller 310 and the collecting roller 320 oppose each other.

Figure 10D:
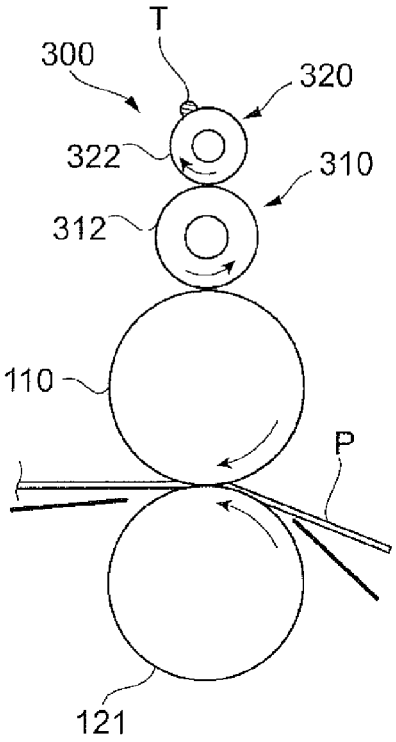

The toner T that has been moved to the position where the cleaning roller 310 and the collecting roller 320 oppose each other is transferred from the cleaning roller 310 to the porous layer 322 of the collecting roller 320, as illustrated in FIG. 10D. The toner T that has been transferred to the porous layer 322 of the collecting roller 320 enters the pores 322*b* formed in the porous layer 322, and is received by the pores 322*b*.

Figure 11:
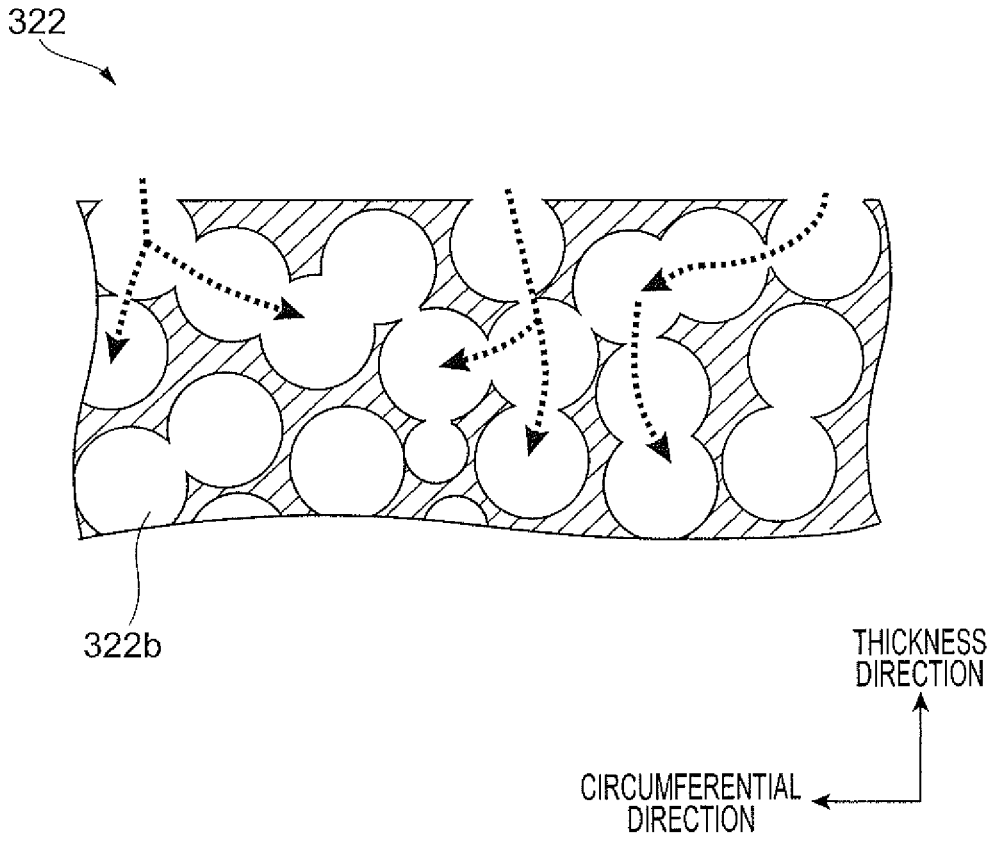
FIG. 11 is a diagram illustrating the flow of toner that has been transferred to the porous layer.

FIG. 11 illustrates the flow of the toner T that has been transferred to the porous layer 322.

As described above, the pores 322*b* that face the cleaning roller 310 (see FIG. 4) are open in the outer peripheral surface of the porous layer 322. The toner that has been transferred from the cleaning roller 310 to the porous layer 322 of the collecting roller 320 is in the molten state and has fluidity.

Accordingly, the toner that has been transferred from the cleaning roller 310 to the porous layer 322 enters the pores 322*b* from the surface of the porous layer 322, as shown by the dashed arrows in FIG. 11.

The pores 322*b* formed in the porous layer 322 are connected to each other in the planar direction and the thickness direction of the porous layer 322.

Accordingly, when the toner that has entered the pores 322*b* from the surface of the porous layer 322 is pushed by the elastic layer 312 of the cleaning roller 310, the toner passes through the pores 322*b* that are connected to each other and is pushed further toward the inner side of the porous layer 322, as illustrated in FIG. 11.

As a result, in the collecting roller 320 according to the present exemplary embodiment, the toner is received not only by the surface of the porous layer 322 but also by the inner region of the porous layer 322. Accordingly, a larger amount of toner may be collected compared to the case in which, for example, a roller having a surface on which projections and recesses are formed by blasting or the like is used as the collecting roller.

With the collecting roller according to the related art having a surface on which projections and recesses are formed, the toner is collected by the projections and recesses formed on the surface of the collecting roller. Accordingly, when a large amount of toner is collected, there is a risk that the projections and recesses on the surface of the collecting roller will be covered with the toner.

In particular, in the regions through which both edges of the sheet P in the width direction pass, the toner that has not adhered to the sheet P easily adheres to the heat roller 110 and the fixing belt 121, and a large amount of toner is collected by the collecting roller. Therefore, according to the related art, a large amount of toner adheres to the collecting roller in the regions corresponding to both edges of the sheet P in the width direction, and when the collecting roller is used for a long time, the projections and recesses formed on the surface of the collecting roller are easily covered with the toner.

When the surface of the collecting roller is covered with the toner, the toner comes into direct contact with the cleaning roller 310. Therefore, there is a risk that the toner collection efficiency of the collecting roller will be reduced.

In contrast, in the collecting roller 320 according to the present exemplary embodiment, the toner collected from the cleaning roller 310 is received by the pores 322*b* formed in the porous layer 322, so that the state in which the skeletal structure 322*a* is exposed at the surface of the porous layer 322 that opposes the cleaning roller 310 is maintained. Accordingly, even when a large amount of toner is collected, reduction in the toner collection efficiency of the collecting roller 320 is suppressed. As a result, the life span of the collecting roller 320 and the cleaning device 300 may be increased.

In the present exemplary embodiment, the pores 322*b* formed in the porous layer 322 are also connected to each other in the width direction. Accordingly, as described above, the toner that has entered the pores 322*b* is also moved in the width direction in the porous layer 322.

Therefore, even when, for example, a large amount of toner is transferred from the cleaning roller 310 to the collecting roller 320 in the regions corresponding to both edges of the sheet P in the width direction, the toner may be moved in the width direction (rotational axis direction of the collecting roller 320) in the porous layer 322. Accordingly, local accumulation of the toner in the porous layer 322 is suppressed and the risk that the toner will accumulate on the surface of the porous layer 322 is reduced.

Toner

The toner used to form an image in the image forming apparatus 1 according to the present exemplary embodiment will now be described. There is no particular limitation regarding the toner to be used in the image forming apparatus 1 according to the present exemplary embodiment. However, considering the toner collection efficiency of the collecting roller 320, it is desirable that the toner have the following characteristics.

That is, the loss tangent (tan δ) of the toner used in the present exemplary embodiment may be in the range of 1 to 3 or about 1 to 3 at 110° C. or about 110° C. The loss tangent (tan δ) is the ratio of the loss shear modulus G" to the storage shear modulus G' (G"/G').

When the loss tangent (tan δ) of the toner is higher than 3 or about 3 at 110° C. or about 110° C., the toner that has adhered to the surface of the porous layer 322 of the collecting roller 320 cannot be easily pushed into the pores 322*b* in the porous layer 322, and there is a risk that the capacity will be reduced. In this case, the amount of toner collectable by the collecting roller 320 is easily reduced. When the loss tangent (tan δ) of the toner is lower than 1 or about 1 at 110° C. or about 110° C., the toner cannot be easily collected on the surface of the porous layer 322 of the collecting roller 320, and there is a risk that a collection failure will occur and the toner will remain on the surface of, for example, the heat roller 110.

The loss tangent (tan δ) of the toner may be determined from, for example, dynamic viscoelasticity measured by the sinusoidal oscillation method.

The collecting roller 320 according to the present exemplary embodiment includes the shaft 321 and the porous layer 322 that are separately formed. However, the shaft 321 and the porous layer 322 may be formed integrally with each other by using a porous material.

In addition, according to the present exemplary embodiment, the fixing device 100 fixes the toner images by using the heat roller 110 and the fixing member 120. However, there is no particular limitation regarding the structure of the fixing device 100 as long as the fixing device 100 includes members that rotate or circulate while applying heat and pressure to the sheet P to fix the toner images to the sheet P.

EXAMPLES

The present invention will be further described by way of examples. However, the present invention is not limited to the examples described below.

First, a method for measuring the properties of the toner and other materials used in an exemplary embodiment of the present invention will be described.

Method for Measuring Grain Size and Grain Size Distribution of Toner

The grain size and grain size distribution of the toner are performed by using Coulter Counter Model TA-II (manufactured by Beckman Coulter Inc.) as a measurement device and ISOTON-II (manufactured by Beckman Coulter Inc.) as an electrolyte as follows.

That is, first, 0.5 to 50 mg of sample material is added to a surface-active agent that serves as a dispersant, for example, 2 ml of a 5% aqueous solution of sodium alkylbenzene sulfonate, and the resulting liquid is added to 100 to 150 ml of the above-mentioned electrolyte. Then, the electrolyte in which the sample material is suspended is subjected to a dispersing process performed by an ultrasonic disperser for about one minute, and the grain size distribution in the range of 2 to 60 μm is measured with the above-mentioned Coulter Counter Model TA-II by using an aperture having an aperture diameter of 100 μm. Accordingly, the volume average grain diameter, the volume average grain size distribution index (GSDv), and the number average grain size distribution index (GSDp) of the toner particles are obtained. The number of particles in the measured sample material is 50000.

Method for Measuring Molecular Weight and Molecular Weight Distribution of Resin The molecular weight distribution of a resin is measured under the following conditions. That is, HLC-8120GPC and SC-8020 (manufactured by Tosoh Corporation) are used as gel permeation chromatography (GPC) devices, and two pieces of TSKgel SuperHM-H (6 mmID×15 cm) (manufactured by Tosoh Corporation) are used as columns. Also, tetrahydrofuran (THF) is used as an eluent.

With regard to the measurement conditions, the sample concentration is 0.5%, the flow velocity is 0.6 ml/min, the amount of sample that is injected is 10 μl, and the measurement temperature is 40° C. An IR detector is used for the detection. Polystyrenes are used as standard samples. More specifically, a calibration curve is formed by using ten polystyrene standard samples (TSK standard: A-500, F-1, F-10, F-80, F-380, A-2500, F-4, F-40, F-128, and F-700, manufactured by Tosoh Corporation).

Method for Measuring Volume Average Particle Diameters of Particles Such as Resin Fine Particles and Coloring Agent Particles The volume average particle diameters of particles such as resin fine particles and coloring agent particles are measured by using a laser diffraction particle size distribution analyzer (LA-700 manufactured by Horiba, Ltd.).

Method for Measuring Melting Points of Resin and Toner and Glass Transition Temperature of Resin The melting points of resin and toner and the glass transition temperature of resin are measured by a method specified by ASTM D3418-8.

Examples 1 to 7

Adjustment of Resin Fine Particle Dispersion Liquid

Bisphenol-A ethylene oxide two-molar adduct 25 parts by weight
Bisphenol-A propylene oxide two-molar adduct 25 parts by weight
Terephthalic acid 30 parts by weight
Succinic acid 5 parts by weight
Trimellitic anhydride 15 parts by weight The above-listed materials are introduced into a round bottom flask that is provided with a stirring device, a gas introducing pipe, a temperature sensor, and a rectifying column, and are heated to a predetermined temperature by using a mantle heater. Then, nitrogen gas is introduced through the gas introducing pipe, and the materials are stirred by the stirring device while an inert gas atmosphere is maintained in the round bottom flask. Then, 0.05 parts by weight of dibutyltin oxide is added per 100 parts by weight of the mixture, and caused to react with the mixture for a predetermine time while the temperature of the reactant is maintained at a predetermined temperature. Thus, a polyester resin is obtained.

The temperature to which the reactant is heated and the reaction time for each of Examples 1 to 7 are set as shown in Table.

Next, the obtained polyester resin is transferred to an emulsification device (Cavitron CD1010, Eurotec Co., Ltd.) at a rate of 100 g per minute while being maintained in the molten state.

A dilute aqueous ammonia solution with a concentration of 0.40%, which is obtained by diluting sample aqueous ammonia with ion-exchanged water, is introduced into an aqueous medium tank that is separately prepared. At the same time as when the polyester resin in the molten state is transferred to the emulsification device, the dilute aqueous ammonia solution is also transferred to the emulsification device at a rate of 0.1 liter per minute while being heated to 120° C. by a heat exchanger.

In this state, the emulsification device is operated while the rotational speed of the rotor is set to 60 Hz and the pressure is set to 0.49 MPa (5 kg/cm$^2$). As a result, resin fine particle dispersion liquid in which particles of polyester resin (resin fine particles) are dispersed is obtained.

Adjustment of Releasing Agent Dispersion Liquid

Polyethylene wax (Polywax 725 manufactured by Toyo Petrolite Co., Ltd., melting temperature 102° C.) 50 parts by weight
Anionic surface-active agent (Neogen R manufactured by DKS Co. Ltd.) 5 parts by weight
Ion-exchanged water 200 parts by weight The above-listed materials are mixed, heated to 110° C. so that they are dissolved, and dispersed by using a homogenizer (ULTRA-TURRAX T50 manufactured by IKA Corporation). Then, a dispersing process is performed by a Manton-Gaulin high-pressure homogenizer (manufactured by Gaulin Corporation), so that a releasing agent dispersion liquid, in which a releasing agent having a volume average particle diameter of 220 nm is dispersed, is produced. The concentration of the releasing agent in the releasing agent dispersion liquid is 20%.

Adjustment of Coloring Agent Dispersion Liquid

Cyan pigment (Pigment Blue 15:3 (copper phthalocyanine) manufactured by Dainichiseika Color & Chemicals mfg. Co., Ltd.) 1000 parts by weight
Anionic surface-active agent (Neogen R manufactured by DKS Co. Ltd.) 150 parts by weight
Ion-exchanged water 9000 parts by weight The above-listed materials are mixed, dissolved, and dispersed for about one hour by using a high-pressure impact disperser Ultimaizer (HJP30006 manufactured by Sugino Machine Co., Ltd.). Thus, a coloring agent dispersion liquid (3), in which a coloring agent (cyan pigment) having a volume average particle diameter of 0.15 μm is dispersed, is produced. The concentration of coloring agent particles in the coloring agent dispersion liquid is 23%.

Manufacturing of Toner Particles

Resin fine particle dispersion liquid 400 parts by weight
Releasing agent dispersion liquid 50 parts by weight
Coloring agent dispersion liquid 22 parts by weight The above-listed materials are introduced into a round stainless steel flask. Then, 1.5 parts by weight of a 10% aqueous solution of polyaluminum chloride (manufactured by Asada Chemical INDUSTRY Co., Ltd.) is added, and pH of the system is adjusted to 2.5 by using a 0.1 N aqueous solution of nitric acid. Then, stirring is performed at room temperature for 30 minutes. Next, mixing dispersion is performed by using a homogenizer (ULTRA-TURRAX T50 manufactured by IKA Corporation), and the temperature is increased to 45° C. and maintained at 45° C. for 30 minutes while stirring is performed in a heating oil bath. Then, 50 parts by weight of resin fine particle dispersion liquid is added, and the temperature is increased to 50° C. and maintained at 50° C. for an hour.

When the resulting material is observed with an optical microscope, it is confirmed that agglomerates having a diameter of around 7.5 μm are generated. Next, pH is adjusted to 7.5 by using an aqueous solution of sodium hydroxide. Then, the temperature is increased to 80° C. and maintained at 80° C. for 2 hours in a heating oil bath.

Then, the resulting material is cooled to room temperature, filtered, cleaned with ion-exchanged water, and dried by using a vacuum dryer. Thus, toner particles are obtained.

Manufacturing of Additive Toner (Electrostatic Charge Image Developing Toner)

One part by weight of colloidal silica (R72 manufactured by Japan Aerosil Co., Ltd.) is added per 100 parts by weight of the obtained toner particles, and additive mixing is performed with a Henschel mixer. Thus, electrostatic charge image developing toner (hereinafter may be referred to simply as toner) is obtained.

Manufacturing of Electrostatic Charge Image Developer

A carbon dispersion liquid is obtained by mixing 1.25 parts by weight of toluene and 0.12 parts by weight of carbon black (VXC-72 manufactured by Cabot Corporation) and subjecting the mixture to stirring dispersion performed by a sand mill for 20 minutes. Then, the obtained carbon dispersion liquid and 1.25 parts by weight of a 80% ethyl acetate solution of trifunctional isocyanate (Takenate D110N manufactured by Takeda Pharmaceutical Co., Ltd.) are mixed and stirred, so that a coating agent resin solution is obtained. Then, the obtained coating agent resin solution and Mn—Mg—Sr ferrite particles (volume average particle diameter: 35 μm) are supplied to a kneader, and are mixed and stirred at normal temperature for 5 minutes. Then, the temperature is increased to 150° C. at normal pressure so that the solvent is removed. Then, mixing and stirring is performed for 30 minutes, and the power of the heater is turned off until the temperature is reduced to 50° C. The resulting material is sieved with a mesh of 75 μm. Thus, carrier is obtained.

Electrostatic charge image developer is obtained by mixing, with a blender, 95 parts by weight of the obtained carrier and 5 parts by weight of the electrostatic charge image developing toner obtained by the above-described method.

Measurement of Loss Tangent (tan δ) of Toner

The loss tangent (tan δ) of the toner of each of Examples 1 to 7 is determined from dynamic viscoelasticity measured by the sinusoidal oscillation method as follows.

From the viewpoint of measurement accuracy, the dynamic viscoelasticity may be measured by the following method. That is, first, the toner is formed into a tablet shape, and is set to parallel plates having a diameter of 25 mm. The normal force is set to 0, and sinusoidal oscillation is applied at an oscillation frequency of 6.28 rad/sec. The measurement is started from 120° C., and is continued until the temperature reaches 200° C. The measurement time interval is set to 30 seconds, and the temperature adjustment accuracy after the start of the measurement is set to ±1.0° C. or less. During the measurement, the amount of strain may be maintained within a predetermined range at each measurement temperature, so that appropriate measurement values may be obtained.

The loss tangent (tan δ) of the toner of each of Examples 1 to 7 at 110° C. is shown in Table 1. As is clear from Table 1, the loss tangent (tan δ) of the toner varies depending on the heating temperature and the reaction time of the reactant in the process of manufacturing the resin fine particle dispersion liquid.

Evaluation of Collecting Performance of Collecting Roller

Images are formed by the image forming apparatus 1 by using the electrostatic charge image developer of each of Examples 1 to 7, and the toner collecting performance of the collecting roller 320 is evaluated.

The toner collecting performance of the collecting roller 320 is evaluated based on the following criteria.

A: the toner is collected by the collecting roller and does not affect the image that is formed.

B: the toner is not sufficiently collected by the toner collection roller, but the image quality is not affected.

C: the toner is not sufficiently collected by the toner collection roller, and degradation of image quality is visually recognizable.

Table 1 shows the result of evaluation of the toner collecting performance of the collecting roller 320 in the case where the electrostatic charge image developers of Examples 1 to 7 are used.

TABLE 1

| | | Example 1 | Example 2 | Example 3 | Example 4 | Example 5 | Example 6 | Example 7 |
|---|---|---|---|---|---|---|---|---|
| Manufacturing Conditions of Resin Fine Particles | Stirring Time (hours) | 1 | 2 | 4 | 6 | 6 | 8 | 10 |
| | Reaction Temperature (° C.) | 200 | 200 | 200 | 200 | 210 | 210 | 210 |
| Loss Tangent (tanδ) | | 5 | 4 | 3.5 | 3 | 2 | 1 | 0.5 |
| Toner Collecting Performance | | C | C | B | A | A | A | C |

As is clear from Table 1, with regard to the loss tangent (tan δ) of the toner at 110° C. or about 110° C., the toner collecting performance of the collecting roller 320 is satisfactory when the loss tangent (tan δ) of the toner is in the range of 1 to 3 or about 1 to 3 (Examples 4 to 6).

In the case where the loss tangent (tan δ) of the toner at 110° C. or about 110° C. is excessively high, unlike the case in which the loss tangent (tan δ) is in the range of 1 to 3 or about 1 to 3, the toner collected on the surface of the porous layer 322 of the collecting roller 320 cannot be easily pushed into the pores 322*b*. Accordingly, the toner collection performance is reduced. In the case where the loss tangent (tan δ) of the toner is excessively low, the toner cannot be easily collected on the surface of the porous layer 322 of the collecting roller 320, and the collection failure easily occurs.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a cleaning member that rotates while being in contact with a member to be cleaned that rotates or circulates, so that an object attached to the member to be cleaned is transferred to the cleaning member; and a collecting member that is made of a porous material having a plurality of pores that are connected to each other, the collecting member rotating while being in contact with a surface of the cleaning member so that the object that has been transferred to the cleaning member is collected in the pores.

2. The cleaning device according to claim 1, wherein the pores are connected to each other in a rotational axis direction of the collecting member.

3. The cleaning device according to claim 1, wherein the collecting member is made of a porous metal.

4. The cleaning device according to claim 1, wherein a surface opening ratio of the collecting member at an outer peripheral surface that is in contact with the surface of the cleaning member is in the range of about 50% to 97%.

5. The cleaning device according to claim 1, wherein a loss tangent (tan δ) of the object that is transferred to the cleaning member is in the range of about 1 to 3 at about 110° C.

6. A collecting member comprising:

a support member that rotates or circulates; and a porous layer that is provided at an outer periphery of the support member and includes a plurality of pores that are connected to each other, the porous layer rotating or circulating with the support member, and being in contact with a member that rotates or circulates and from which an object is to be collected, so that the object, which is attached to the member, is collected in the pores.

7. The collecting member according to claim 6, wherein an average diameter of the pores in the porous layer is in the range of about 5 μm to 1000 μm.

8. The collecting member according to claim 6, wherein a volume porosity of the porous layer is in the range of about 50% to 97%.

9. The collecting member according to claim 6, wherein the porous layer further includes a plurality of small pores that have a diameter smaller than a diameter of the pores and that are connected to each other.

10. The collecting member according to claim 6, wherein a loss tangent (tan δ) of the object that is collected in the pores is in the range of about 1 to 3 at about 110° C.

11. A fixing device comprising:

a pair of fixing members that rotate or circulate while being in contact with each other and that apply heat and pressure to a recording medium, on which a toner image is formed, while sandwiching the recording medium, so that the toner image is fixed to the recording medium;

a cleaning member that rotates while being in contact with at least one of the fixing members, so that an object attached to the at least one of the fixing members is transferred to the cleaning member; and a collecting member that is made of a porous material having a plurality of pores that are connected to each other, the collecting member rotating while being in contact with a surface of the cleaning member so that the object that has been transferred to the cleaning member is collected in the pores.

12. The fixing device according to claim 11, wherein a loss tangent (tan δ) of the object that is transferred to the cleaning member is in the range of about 1 to 3 at about 110° C.

13. An image forming apparatus comprising:

a toner-image forming unit that forms a toner image;

a transfer unit that transfers the toner image onto a recording medium;

a pair of fixing members that rotate or circulate while being in contact with each other and that apply heat and pressure to the recording medium, onto which the toner image has been transferred, while sandwiching the recording medium, so that the toner image is fixed to the recording medium;

a cleaning member that rotates while being in contact with at least one of the fixing members, so that an object attached to the at least one of the fixing members is transferred to the cleaning member; and a collecting member that is made of a porous material having a plurality of pores that are connected to each other, the collecting member rotating while being in contact with a surface of the cleaning member so that the object that has been transferred to the cleaning member is collected in the pores.

14. The cleaning device according to claim 1, the porous material rotating with the collecting member while being in contact with a surface of the cleaning member.

15. The fixing device according to claim 11, the porous material rotating with the collecting member while being in contact with a surface of the cleaning member.

16. The image forming apparatus according to claim 13, the porous material rotating with the collecting member while being in contact with a surface of the cleaning member.

* * * * *